United States Patent [19]

Williams

[11] 4,277,901

[45] Jul. 14, 1981

[54] WATERCOLOR PAPER STRETCHER

[76] Inventor: Hugh M. Williams, 34 NE. 37, Oklahoma City, Okla. 73105

[21] Appl. No.: 23,820

[22] Filed: Mar. 26, 1979

[51] Int. Cl.[3] ..... D05C 1/04

[52] U.S. Cl. ..... 38/102.2; 118/503; 206/1.7

[58] Field of Search ..... 38/102.1, 102.2; 118/33, 503; 160/374.1; 206/1.7–1.9; 248/441 R

[56] References Cited

U.S. PATENT DOCUMENTS

| | | | |
|---|---|---|---|
| 1,200,052 | 10/1916 | Trover | 38/102.1 |
| 3,608,517 | 9/1971 | Shroff | 118/503 X |
| 3,633,541 | 1/1972 | Andrews | 118/503 |
| 3,768,440 | 10/1973 | Doman et al. | 118/503 |
| 3,885,333 | 5/1975 | Zachary | 38/102.2 |

*Primary Examiner*—Louis Rimrodt
*Attorney, Agent, or Firm*—Robert K. Rhea

[57] ABSTRACT

A downwardly open substantially box-like frame has the central portion of its top offset upwardly and lying in a horizontal plane spaced above the remaining portion of its top for flatly receiving a wet sheet of artist's watercolor paper. The frame top is further characterized by a recess surrounding its raised portion. A clamp surrounds the frame walls and includes an inwardly projecting flange overlying the frame top outwardly of the raised portion and impinging a marginal edge portion of the watercolor paper within the frame top recess. The frame and clamp member are maintained in watercolor paper clamped relation by an elongated binder gripping outward opposing surfaces of the respective juxtaposed side and end walls.

6 Claims, 5 Drawing Figures

WATERCOLOR PAPER STRETCHER

BACKGROUND OF THE INVENTION

1. Field of the invention

The present invention relates to artist's materials and more particularly to a watercolor paper stretcher.

As is well known a sheet of watercolor paper is preferably soaked or sponged until limp and thereafter anchored by its marginal edge portions until dry so that the paper remains flat while applying watercolor, principally for controlling the flow of fluids thereon.

This is usually accomplished by stapling or using wetable tape and securing marginal edge portions of the wet paper on a flat panel until dry, however, it is inconvenient to transport such flat panels when painting watercolor drawings in the field.

2. Description of the prior art

Prior art patents have generally related to artist's canvas stretching devices, such as disclosed by U.S. Pat. No. 3,885,333, in which cooperating concentric hoop-like members impinge the canvas material therebetween and is provided with prongs or tangs which engage the fabric material for securing and stretching the fabric. Another stretching device is disclosed by U.S. Pat. No. 3,633,541 for supporting fabric by concentric hoop members which includes a multilayer absorbant support receiving excess paint or ink passing through the fabric when painted. Devices of this type are generally unsatisfactory when attempting to maintain the flat configuration of a sheet of wet watercolor paper while drying.

This invention provides a telescoping frame-like device which impinges marginal edge portions of a wet sheet of watercolor paper until dry and while being painted.

SUMMARY OF THE INVENTION

A downwardly open substantially box-like frame, having dimensions preferably greater than the length and width of watercolor paper to be stretched, has the central portion of its top offset upwardly and lying in a plane parallel with the remainder of its top surface. The frame top is further characterized by a transversely arcuate recess surrounding its raised portion. A clamp member surrounds the marginal edge surfaces of the frame and is characterized by an inwardly projecting flange flatly overlying the frame top around its central raised portion with the inner edge of the flange having a coextensive rib cooperatively received by the recess for impinging marginal edge portions of a sheet of watercolor paper when overlying and projecting beyond the frame top raised portion. The frame and clamp member are maintained in telescoped watercolor paper clamped relation by a flexible elongated channel-like binder nesting the depending edge portions of the respective juxtaposed side and end walls in gripping relation.

The principal object of this invention is to provide a device which grips marginal edge portions of thoroughly wet watercolor paper while drying and which serves as a portable holder for the paper while drawing or painting.

DESCRIPTION OF THE PREFERRED EMBODIMENT

Figure 1:
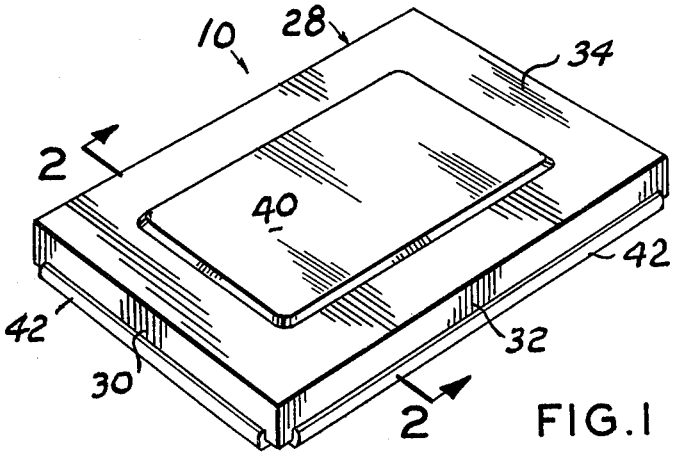
FIG. 1 is a perspective view of the device.
Figure 4:
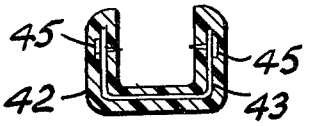
FIG. 4 is a vertical cross sectional view, to an enlarged scale, taken substantially along the line 4—4 of FIG. 3; and, FIG. 5 is a bottom view, to a smaller scale, of the device illustrating the transporting position of extra sheets of prestretched watercolor paper and a carrying handle.

Like characters of reference designate like parts in those figures of the drawings in which they occur.

In the drawings:

The reference numeral 10 indicates the device, as a whole, which is rectangular flat box-like in general configuration. The device 10 is preferably formed from light weight sheet material and comprises a downwardly open frame 12 having dimensions greater than the dimensions of watercolor paper to be stretched and having downwardly diverging end and side walls 14 and 16 joined by a horizontal top wall. A rectangular central portion 20 of the top wall is offset or elevated to lie in a horizontal plane spaced above marginal edge portions 22 of the top wall, preferably a distance at least equal to the thickness of the top wall. The perimeter of the top wall raised portion 20 is defined by an inclined downwardly diverging surface 24 terminating at its juncture with the top marginal edge portions 22 in a recess 26, arcuate in transverse section, for the purposes presently explained.

Figure 2:
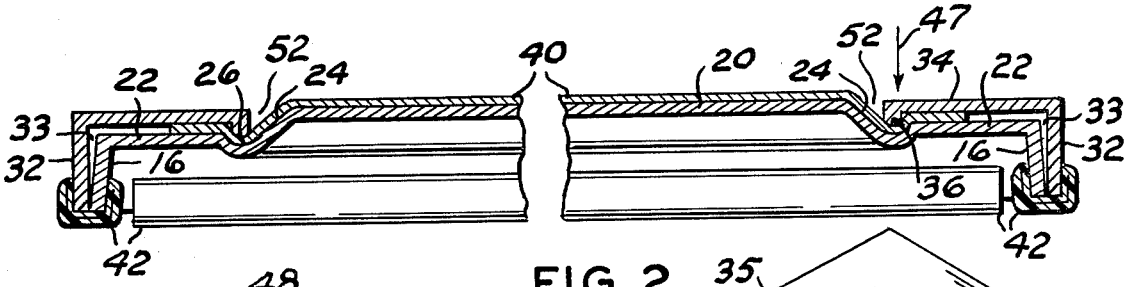
FIG. 2 is a vertical cross sectional view, to a larger scale, taken substantially along the line 2—2 of FIG. 1.

Paper clamping means 28 comprising an open frame, provided with substantially parallel end and side walls 30 and 32, of slightly greater height than the frame side and end walls by a distance at least equal to the top wall thickness, is telescoped over the perimeter of the frame 12. The angle of divergence of the frame side and end walls is preferably such that a wedge-shaped space 33 of approximately 2° is formed between the respective frame and clamp member side and end walls when disposed as shown by FIG. 2 for the purposes presently explained.

The clamp means 28 further includes an integral inwardly projecting flange portion 34, substantially normal to the plane of its side and end walls, overlying the top wall marginal edge portions 22, defining a central rectangular opening 35 and terminating in a coextensive depending lip portion 36 nested by the recess 26 for impinging a marginal edge portion of a sheet of watercolor paper 40 when centrally disposed in overlying relation on the frame raised top portion 20. The dimensions of the watercolor paper 40 is greater than the dimensions of the frame raised top portion 20 and terminates inwardly of the perimeter of the frame 12.

Anchor means 42 maintains the frame and clamp member assembled while the paper drys. The anchor means 42 comprises an elongated channel-like strip of conventional automotive protective edge molding sometimes referred to as a "door guard strip". A plurality of strips of the anchor means is used, one for each of the juxtaposed side and end walls which are substantially coextensive therewith. The anchor means is formed from pliable plastic material having a coextensive row of juxtaposed bendable U-shaped wire members 43 imbedded therein and includes imbedded opposing longitudinally spaced-apart pairs of tacks 45, or the like, with their points disposed in confronting relation.

The anchor strip frictionally grips opposing surfaces when the bight portion of the U-shaped channel nests an exposed edge surface and the tacks 45 normally maintain the strip in place.

As best shown by FIG. 2, the anchor means 42 envelopes the depending edges of the respective juxtaposed side and end walls of the frame and clamp member and tends to force the clamp member respective side and end wall toward the downwardly diverging walls of the frame member by fulcruming the flange lip portion 36 toward the frame recess 26, in the direction of the arrow 47.

Figure 5:
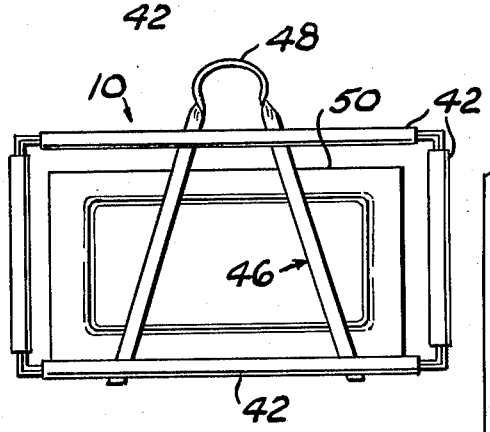
Figure 3:
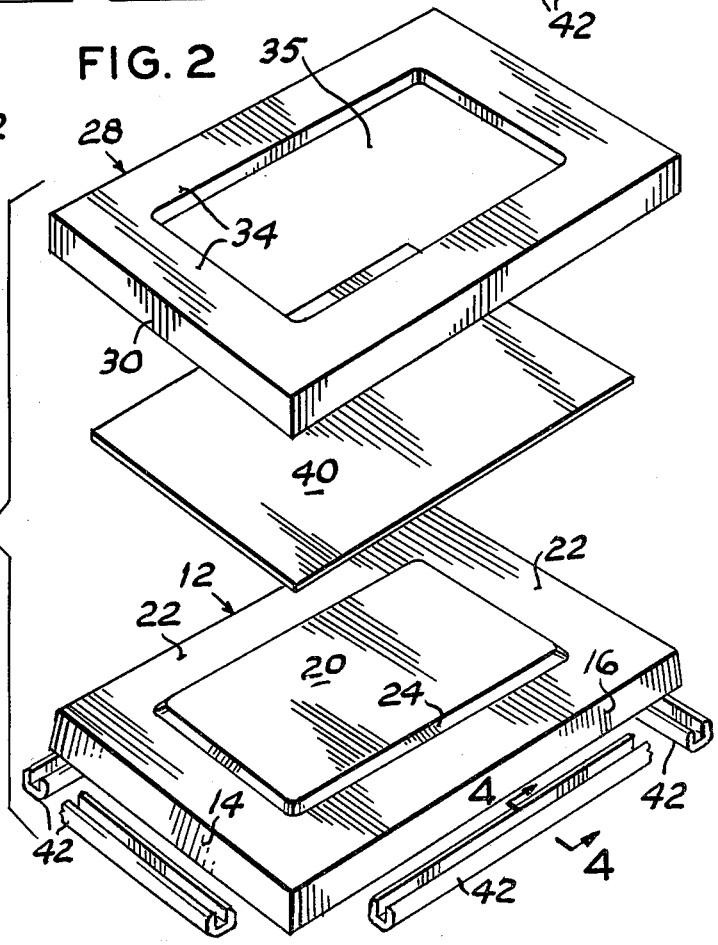
FIG. 3 is an exploded perspective view of the device including a sheet of watercolor paper.

As illustrated by FIG. 5, a strand or strip of ribbon-like fabric material 46 is disposed in an inverted substantially V-shape with its respective end portions interposed between the anchor means 42 and one longitudinal side edge of the assembled clamp and frame members with an intermediate portion of the strip 46 similarly gripped by the anchor means at the opposite side edge of the frame and clamp members thus forming a handle 48 by the apex portion of the V-shape for carrying the device. Prior to attaching the material 46 to the device, a plurality of juxtaposed sheets of previously stretched and dried watercolor paper 50 may be flatly nested within the side and end walls of the frame for transporting the device and spare sheets of watercolor paper.

Operation

In operation, the watercolor paper 40 is immersed in water, or at least sponged, until completely impregnated with water so that the watercolor paper is limp and while in a limp state, is placed in overlying relation on the frame top with its marginal edge portions projecting substantially equidistant beyond the recess 26. The clamp member 28 is then telescoped over the frame 12 so that the flange lip 36 impinges the watercolor paper against the recess 26.

The anchor means 42 is then applied to the depending edge portion of the juxtaposed side and end walls and the device 10 set aside until the watercolor paper has dried by evaporation of the moisture therein. This results in a flat central surface of the watercolor paper contiguously overlying the frame top portion 20 for subsequent painting thereon. The inner edge of the clamp member flange defining the opening 35, in combination with that portion of the watercolor paper overlying the inclined surface 24, forms a well 52 for trapping excess watercolor, not shown, draining off the surface of the watercolor paper. Obviously, a plurality of sheets of watercolor paper may be successively mounted on the device and dried to form a supply of watercolor sheets ready for painting which may be individually supported by the device in paper clamped position.

Obviously the invention is susceptible to changes or alterations without defeating its practicability. Therefore, I do not wish to be confined to the preferred embodiment shown in the drawings and described herein.

I claim:

1. A watercolor paper stretcher, comprising:

a one-piece box-like downwardly open sheet material frame having side and end walls joined by a generally horizontal top wall having an upper surface, said top wall having an elevated central planar portion lying in a plane spaced above the remaining marginal edge portions of said upper surface a distance at least equal to the thickness of the top wall for receiving a sheet of watercolor paper when superposed thereon with its marginal edge portions projecting beyond the perimeter of the elevated portion; and, sheet material clamp means surrounding said frame elevated portion for impinging the watercolor paper against said upper surface, said clamp means including a one-piece open clamp frame having side and end walls closely surrounding said frame side and end walls and having an inwardly projecting flange at its upper limit overlying said marginal edge portions of said upper surface in a plane below the plane of said elevated portion.

2. The paper stretcher according to claim 1 in which said inwardly projecting flange is provided with a coextensive depending lip facing said upper surface.

3. The paper stretcher according to claim 2 in which said upper surface is provided with an upwardly open recess underlying the position of said depending lip.

4. The paper stretcher according to claim 1 or 3 and further including:

anchor means for securing said clamp means to said frame.

5. The paper stretcher according to claim 4 in which the anchor means includes:

an elongated channel-like member frictionally enveloping the depending edge portions of the respective juxtaposed side and end walls.

6. The paper stretcher according to claim 4 in which the end and side walls of said frame diverge downwardly and said clamp means side and end walls are respectively substantially parallel and in which said anchor means includes:

an elongated channel-like member frictionally enveloping the depending edge portions of the respective juxtaposed side and end walls for biasing said lip toward the frame recess.

* * * * *